US009464484B2

(12) United States Patent
Baudoin

(10) Patent No.: US 9,464,484 B2
(45) Date of Patent: Oct. 11, 2016

(54) HYDRAULIC PERCUSSION APPARATUS AND METHOD OF USE

(71) Applicant: KLX ENERGY SERVICES LLC, Houston, TX (US)

(72) Inventor: Toby Scott Baudoin, Rayne, LA (US)

(73) Assignee: KLX Energy Services LLC, Houston, TX (US)

( * ) Notice: Subject to any disclaimer, the term of this patent is extended or adjusted under 35 U.S.C. 154(b) by 471 days.

(21) Appl. No.: 14/085,209

(22) Filed: Nov. 20, 2013

(65) Prior Publication Data

US 2014/0144705 A1 May 29, 2014

Related U.S. Application Data

(60) Provisional application No. 61/728,422, filed on Nov. 20, 2012.

(51) Int. Cl.

| | |
|---|---|
| ***E21B 7/24*** | (2006.01) |
| ***E21B 1/00*** | (2006.01) |
| ***E21B 4/06*** | (2006.01) |
| ***E21B 4/14*** | (2006.01) |

(52) U.S. Cl.
CPC . *E21B 7/24* (2013.01); *E21B 1/00* (2013.01); *E21B 4/06* (2013.01); *E21B 4/14* (2013.01)

(58) Field of Classification Search
CPC ..... E21B 1/00; E21B 1/02; E21B 4/00; E21B 4/06; E21B 4/14; E21B 7/24
See application file for complete search history.

(56) References Cited

U.S. PATENT DOCUMENTS

| | | | | |
|---|---|---|---|---|
| 4,271,915 | A * | 6/1981 | Bodine | E21B 7/24 175/105 |
| 5,662,180 | A * | 9/1997 | Coffman | E21B 4/14 173/112 |
| 5,711,380 | A | 1/1998 | Chen | |
| 6,279,670 | B1 * | 8/2001 | Eddison | E21B 4/02 175/107 |
| 6,431,294 | B1 | 8/2002 | Eddison et al. | |
| 6,439,318 | B1 | 8/2002 | Eddison et al. | |
| 6,508,317 | B2 | 1/2003 | Eddison et al. | |
| 7,011,156 | B2 | 3/2006 | von Gynz-Rekowski | |
| 7,434,623 | B2 | 10/2008 | von Gynz-Rekowski | |
| 7,882,906 | B1 | 2/2011 | DeCuir, Sr. | |
| 2004/0159464 | A1 * | 8/2004 | von Gynz-Rekowski | E21B 4/14 175/57 |
| 2013/0277116 | A1 * | 10/2013 | Knull | E21B 4/003 175/57 |

* cited by examiner

*Primary Examiner* — Yong-Suk (Philip) Ro
(74) *Attorney, Agent, or Firm* — Drinker Biddle & Reath LLP

(57) ABSTRACT

A hydraulic percussive apparatus is disclosed for generating vibrating forces to a pipe string. The apparatus is attached to the pipe string a central bore through which fluid may be introduced into the apparatus. The apparatus has a tubular housing, an anvil surface with an irregularly profiled surface, and a rotor with an irregularly profiled hammer surface that is urged to move axially toward and away from the anvil surface. The rotor has a longitudinally extending fluid bore and a tangentially oriented fluid port in communication with the longitudinal fluid bore of the rotor. Fluid entering the rotor's fluid bore and exiting the rotor's tangentially oriented fluid port rotates the rotor, and thus the irregularly profiled hammer surface on the irregularly profiled anvil surface, moving the hammer surface toward and away from the anvil producing intermittent impact forces.

30 Claims, 3 Drawing Sheets

HYDRAULIC PERCUSSION APPARATUS AND METHOD OF USE

PRIORITY

This application claims priority to U.S. provisional application Ser. No. 61/728,422 filed Nov. 20, 2012 for Hydraulic Percussion Apparatus and Method of Use, the entire content of which is hereby incorporated by reference.

FIELD OF THE INVENTION

This invention pertains to downhole equipment for oil and gas wells. More particularly, it pertains to a hydraulic percussive apparatus for use on a wellbore pipe string such as a drillstring or coiled tubing string and, more particularly, this invention relates to an apparatus for imparting repeated percussions or impacts to the pipe string.

BACKGROUND OF THE INVENTION

A variety of geologic formations are often encountered as a wellbore is progressed during the drilling of an oil and gas well. Often these formations are comprised of very hard and sometimes brittle material such as rock, stone or shale. A rotating drill bit is placed at the end of a pipe string and is used to advance the wellbore through the various geologic formations. The rotary motion of the drill bit aids in removing the fragments of formation so that they may be carried uphole back to surface via circulating drilling mud pumped through the drillstring from the surface and exiting the drill bit.

A typical drill bit used for hard and rocky formations will have rotating cutters that are comprised of very hard materials such as PDC (polycrystalline diamond compact). These rotating cutters shear or scrape away rocky formation material as they are forcibly dragged along the surface of formation being drilled on each revolution. Drill bits having roller cone cutters work in a similar manner in that the teeth or cutters mounted on each cone will gouge, scrape, or chip away formation material as the bit advances.

The hard and brittle formations that are frequently encountered can be difficult to drill by merely rotating a drill bit. Drilling through such formation is often significantly improved by the addition of percussive motions or forces onto the drill bit. These percussive forces cause the rock to shatter and fragment as the rotating bit is advanced. This process is similar to the use of an ordinary electric drill when attempting to drill a hole in concrete (not a hammer drill). The rotation of the drill bit alone is ineffective as the rotation will cause the bit to simply heat up and become dull rather than advance the hole. When a hammer drill is utilized, the percussive motion of the hammer drill enhances the drilling progress and the drill bit lasts many times longer.

Many percussive devices on the market today rely on "weight on bit" to be applied to cause axial movement within the percussive device to initiate the percussive motion or hammering effect of the percussive device on the drill bit. If the weight on bit is too great, the percussive device stalls thus stopping the percussive effect. The driller must then pick up the drillstring and then set back down to restart the percussive device. This process is very time consuming, therefore is not an adequate or economical solution. Other percussive devices rely on turbine technology to power the percussive device. Such turbine technology is very complex and the percussive devices that rely on such technology are expensive and complicated to manufacture.

Another disadvantage to some percussive devices is that such devices have no mechanism for or method of increasing or decreasing the magnitude of percussive forces applied to the drill bit. Yet another disadvantage of many percussive devices is that these devices have relatively small impact areas or anvil surfaces. Impact forces on small contact surfaces areas produces high localized stresses which leads to excessive wear and ultimately premature failure of the percussive devices.

Further, in drilling and or workover operations, it is often necessary to pump a ball through the components of a BHA (bottom hole assembly) in order to shift sleeves, disconnect, or otherwise manipulate components of tools positioned on the drillstring downhole from the percussive device. It would be an advantage to provide a percussive device that allows for a ball to be pumped down the pipe string and through the device for manipulation of a tool positioned downhole from the percussive device. Similarly, it would be an advantage for a percussive device to allow for the passage of wireline tool strings through the percussive device for the manipulation of tool components positioned further downhole on the drillstring.

Consequently, there is a need for a hydraulic percussive apparatus that will serve to impart repeated impacts without the negative attributes noted above and with the aforesaid advantages.

SUMMARY OF THE INVENTION

The present invention is for a hydraulic percussive apparatus that satisfies the aforementioned needs. The percussive apparatus is comprised of a tubular housing having a longitudinally extending central bore through which fluid may be introduced. This fluid may be a liquid, gas, or combination thereof. The tubular housing is configured for attachment to a pipe string, coiled tubing, or the like. Positioned within the housing is a rotating shaft known as a rotor and a stationary member known as a compression sleeve.

The rotor is comprised of a longitudinally oriented central shaft section having a longitudinal fluid bore there-through and having one or more tangentially oriented fluid ports in communication with the longitudinal fluid bore. The axis of each of the fluid ports is positioned so that it is transverse and generally perpendicular to, but does not intersect, the longitudinal axis of the rotor. Fluid entering the fluid bore and exiting the fluid ports provides for rotation of the rotor. The(se) fluid port(s) can be varied by number, size, shape, orientation, direction, or by any permutation thereof. Adjustment of the number, size, shape, orientation, direction of the fluid ports will allow the rotational speed and torque output of the rotor to be adjusted.

Fluid introduced into the central bore of the pipe string circulates through the percussive apparatus primarily through the compression sleeve and then to the fluid bore of the rotor. The majority of the fluid entering the fluid bore of the rotor will exit the rotor fluid bore through the tangential fluid port(s). Only a portion of the fluid entering the fluid bore of the rotor will travel directly through the rotor fluid bore to exit the apparatus. The fluid exiting the rotor through the tangential fluid port(s) will create forces on the rotor that cause the rotor to rotate about its longitudinal axis. This exiting fluid then travels through radial ports in the rotor back to the central bore of the rotor where it exits the apparatus.

A compression sleeve is affixed to the tubular housing in a manner to allow relative axial movement while disallowing relative rotational movement. This is accomplished via one or more methods such as the use of splines, flats, keyways, or the like between the tubular housing and the compression sleeve. The compression sleeve is urged or biased toward the upper surface rotor of the rotor by a biasing force produced by a biasing means such as a spring. The biasing spring may be any one or more of a variety of spring types such as a coiled spring, a die spring, a urethane spring, a disc spring, a combination of such spring types, or any other means for biasing or urging the compression sleeve toward the rotor.

A means for minimizing friction such as a thrust washer or bearing is placed between the compression sleeve and the rotor in order to minimize friction at the bearing face between these two components. The thrust bearing(s) may be any one of various forms bearings including but not limited to ball or roller bearings, plain bearings, or ultra hard material bearings such as those comprised of carbide, PDC (polycrystalline diamond compact), or ceramic. The thrust bearing may be incorporated into the rotor and/or the compression sleeve to reduce the number of individual components of the apparatus.

The lower surface or base of the rotor, at the rotor end opposite to that of the compression sleeve, has a surface profile comprised of a plurality rough or jagged projections, preferably a series of ridged or stepped saw-tooth projections. The series of ridged projections provides an irregular surface profile or hammer face. The hammer face or base profile of the rotor is configured to correspond with a similar irregular surface profile or anvil face at the upper end surface of a bottom sub connected to the housing at a position adjacent to the lower end of said rotor. The hammer face of the rotor or anvil face of the bottom sub may be integral features of the rotor or the bottom sub. The hammer face of the rotor or anvil face of the bottom sub may also be features of a separate component affixed to the rotor or the bottom sub by some attachment means. A means for attaching such a separate component to the hammer face of the rotor or anvil face of the bottom sub may include threading, welding, brazing, press fitting, shrink fitting, or other suitable means for attaching a separate component to the rotor or bottom sub.

The relative rotation between the rotor and the bottom sub causes an axial reciprocation of the rotor so that the hammer face of the rotor will rides up and fall against the anvil face of the bottom sub due to their interfacing irregular surface profiles. Each time the rotor "falls", the hammer face of the rotor collides with the anvil face of the bottom sub producing a percussion or impact force. These repeated impact forces create a percussive or hammering effect. The rough or jagged projections creating the irregular surface profile on the hammer face of the rotor and the anvil face of the bottom sub may be varied in size, shape, height, and number to change the amplitude or magnitude of the percussions (impacts) as well as the frequency of such impacts.

The magnitude of these impact forces can be varied by several means. First, the height of the profiles can be modified which changes the axial distance that the rotor "falls" on each impact. Secondly, the mass of the rotor can be modified so that the momentum of the rotor changes on each impact. Third, the spring force(s) acting upon the rotor by spring biased compression sleeve and the thrust bearing can be modified. Further, the size of the orifice or hole diameter of the longitudinal fluid bore of the rotor may be modified to change the forces acting upon the rotor due to pump pressures.

The frequency of the impact forces can be varied by several means. First, the number of saw-tooth profiles per revolution can be modified. Increasing the number of profiles increases the frequency of impact. Secondly, adjusting the size, shape, number, and orientation of the tangential fluid port(s) changes the rotational speed of the rotor which effects frequency. A third means, which works in conjunction with the aforementioned tangential fluid port(s), is varying the size of the orifice or hole through the longitudinal fluid bore of the rotor. Increasing the hole size of the fluid bore of the rotor will decrease the fluid flow through the tangential fluid port(s) thereby reducing the rotational speed of the rotor.

The present invention also contemplates a hydraulic percussion apparatus of the type described herein configured to function in or in conjunction with a: casing bit, casing reamer, casing shoe, casing collar, casing float, casing shoe, or casing running, casing drilling, or casing cementing equipment. The hydraulic percussion apparatus of the present invention may include or incorporate a float valve which is commonly known in the art. When used for casing running, drilling with casing, or casing cementing operations, the materials used to manufacture the present invention may be of softer or "drillable" materials. The term "drillable" refers to materials which can be easily drilled using standard roller cone or PDC bits. These materials may include aluminum, composites, plastics, cement, etc.

It is common in the industry to drill out the casing float equipment (which may include the casing shoe or casing bit) once the desired length casing is run into the wellbore. The hydraulic percussion apparatus of the present invention may also include a locking means to lock the internal components of the apparatus from rotating while being drilled out. Drillstrings rotate in a clockwise direction (standing on surface facing downhole). Thus, the rotor inside the hydraulic percussion device must rotate in a counterclockwise direction. The saw-tooth profiles of the apparatus must be designed such that the rotor can spin counterclockwise but not allowed to rotate clockwise (locked in the clockwise direction). This "locking" feature will allow the drillstring and thus drill bit rotating in a clockwise direction to easily drill out the hydraulic percussion apparatus (or internals of hydraulic percussion apparatus) and other float equipment. Without this "locking" feature, the internals of the hydraulic percussion apparatus would spin with the drill bit and drilling out or removing these components would be very difficult or nearly impossible.

These repeated percussions can be utilized to aid in the drilling of formation, cement, plugs, scale, rock, or the like in a wellbore or pipe. These repeated percussions can also be utilized in fishing operations to introduce vibrations in an attempt to free stuck objects in a wellbore. These repeated percussions may further be used to assist in running casing or tubing into a wellbore by introducing vibrations which reduce the friction between the casing or tubing and the wellbore. While running casing or drilling with casing, these repeated percussions may aid the casing bit in removing materials which is preventing it from continuing into the wellbore.

DESCRIPTION OF THE EMBODIMENTS

Figure 1:
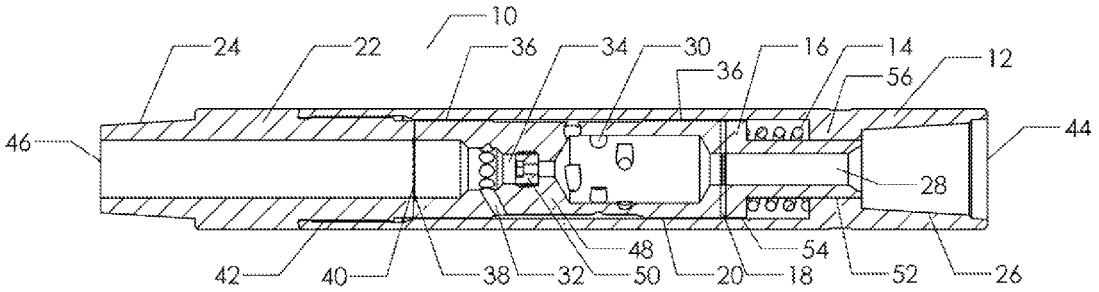
FIG. 1 is a longitudinal cross-section view of an embodiment of the hydraulic percussion apparatus of Applicant's invention.

FIG. 1 shows an embodiment of the hydraulic percussive apparatus (10) of the present invention utilized to provide downward percussive or hammering forces. The apparatus (10) is configured for threadable attachment to a pipe string deployed in a wellbore having a central bore through which fluid may be introduced. The apparatus (10) is intended to be positioned on the pipe string so that it will extend longitudinally along the axis of the pipe string to which it is threadably attached.

In the configuration shown in FIG. 1, the apparatus (10) has an upper end (51) and lower end (53) and is comprised of a tubular housing (12) that is threadably attached to a bottom sub (22) at threaded connection surface (42). The apparatus (10) is configured for threadable attachment to a pipe string by the means of an upper threaded connection (26) on the housing (12), shown as box connection (46), and a lower threaded connection (24) shown as a pin connection (29), on the bottom sub (22). The tubular housing (12) and bottom sub (22) each have central bores, (28) and (46) respectively, which are in communication with the central bore of the pipe string.

Positioned within the housing (12) is a rotatably mounted rotor (48), thrust bearing (18), compression sleeve (16), and spring (14). Housing (12) and rotor (48) are illustrated as a single components but may consist of a multitude of individual parts connected together possibly by one or more of several means such as: threaded connections, splines, keyways, welding, brazing, press or shrink fitting, or the like.

Rotor (48) is comprised of a shaft section having a longitudinal fluid bore (34), one or more tangentially positioned fluid port(s) (30), fluid bore orifice or hole (50), one or more radial fluid port(s) (32), and radial bearings (36). The rotor (48) also has a thrust bearing surface (15) that is positioned on the upper face of rotor (48). The rotor (48) is positioned axially between bottom sub (22) and thrust bearing (18) so that the bearing surface (15) will bear against thrust bearing (18).

The thrust bearing surface (15) of the rotor (48) may be integral to the rotor as shown and may be comprised of simply a polished metal face, a hardened and ground surface, a curved face to receive ball bearings, a flat or tapered face to receive roller bearings, hard materials such as carbide or PDC (polycrystalline diamond compact), or have any other suitable bearing surface. Thrust bearing surface (15) may also be adapted to receive a separate bearing component (not shown) that has the aforementioned bearing features that will constitute a portion of thrust bearing (18) or the entirety of thrust bearing (18). Thrust bearing (18) is shown as a thrust washer for simplicity and clarity of the illustration but thrust bearing (18) can be of any suitable configuration.

Figure 2:
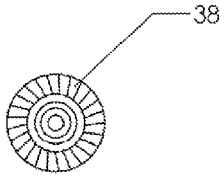
FIG. 2 is an end view of the rotor member of the hydraulic percussion apparatus shown in FIG. 1.
Figure 4:
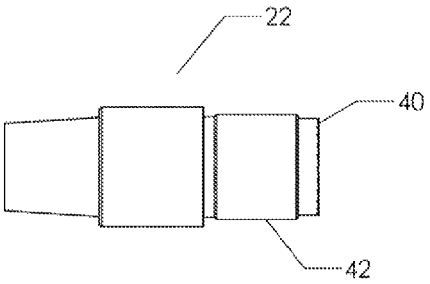
FIG. 4 is a side view of the bottom sub member of the hydraulic percussion apparatus shown in FIG. 1.
Figure 5:
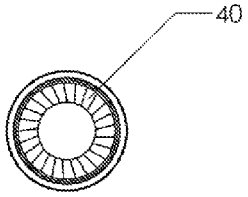
FIG. 5 is an end view of the bottom sub member of the hydraulic percussion apparatus shown in FIG. 1.

As shown in FIG. 2, an end view of rotor (48), the lower or hammer face of the rotor (48) has a profiled hammer surface (38). The profiled surface (38) of rotor (48) is constructed to mate with an upper or anvil face on the of the bottom sub (22) having a corresponding profiled anvil surface (40) shown in FIG. 4 and FIG. 5. Profiled surface (38) is shown for simplicity as a feature of the rotor (48) but may it also be a feature of separate component which is affixed to the rotor (48) by some means such as threads, splines, welding, brazing, keyways, press or shrink fitting, or other suitable connection means. The surface features of the profiled surfaces (38) and (40) are shown FIG. 11 and FIG. 12, by way of example, as rough dentate or saw-tooth type features.

Compression sleeve (16) is concentrically located within housing (12) between thrust bearing (18) and compression spring (14). The compression sleeve (16) is configured to allow travel axially along the housing (12) but not rotationally. Compression sleeve (16) may be constrained against rotation by providing splined surfaces on compression sleeve surface (52) and the interior surface (56) of the housing (12). The term splined is used as a reference only as any other suitable means for constraining rotation of the compression sleeve (16) with respect to the housing (12) may be incorporated between adjoining surfaces of compression sleeve (16) and housing (12) to prevent rotation such as flats, keyways, and the like. An internal splined surface on the housing (12) configured with a splined compression sleeve surface (54) may also be provided in lieu of or in addition to the splined surfaces on compression sleeve surface (52) and housing interior surface (56).

The compression spring (14) is concentrically located within housing (12) between compression sleeve (16) and a shoulder (47) on the interior of the housing (12). The compressing spring (14) includes any suitable spring for biasing or pushing the compression sleeve (16) against the thrust bearing (18) and bearing surface (15) of the rotor (48) such as coiled springs, disc springs, die springs, urethane springs, wave springs, wire springs, tapered springs, or the like. Compression spring (14) may also consist of more than one springs or type of springs. The purpose of compression spring (14) is to provide a means for applying a predetermined axial force onto the rotor (48), thereby placing rotor profiled surface (38) into contact with profiled surface (40) on the sub (22).

Figure 3:
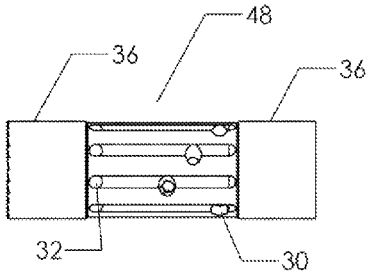
FIG. 3 is a side view of the rotor member of the hydraulic percussion apparatus shown in FIG. 1.

FIG. 3, a side view of rotor (48), illustrates the location and orientation of radial bearings (36) and fluid port(s) (30) and (32) of the rotor (48). Also shown in FIG. 3 are grooves or flutes (45) along the periphery of the rotor (48) which serve a fluid channels to aid in fluid communication between ports (30) and (32). Radial bearings (36) have hardened and ground surfaces which are closely toleranced to the interior surface (43) of housing (12). These hardened and ground surfaces may contain rotary seals (not shown). The fluid port(s) (30) may be comprised of one or more holes that are drilled in the rotor in a tangential orientation and spaced some desired distance away from the central axis. These port(s) (30) may also contain nozzles, constricting orifices, or jets of varying size or shape. These port(s) are in fluid communication with annulus (41) between the housing (12) and rotor (48).

Figure 13:
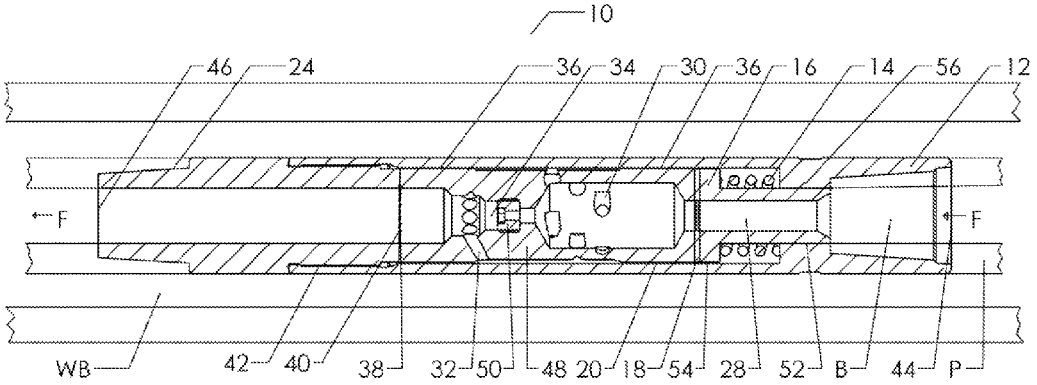
FIG. 13 is a cross-section view of a wellbore with an embodiment of the hydraulic percussion apparatus of Applicant's invention attached to a pipe string.

FIG. 13 shows hydraulic percussive apparatus (10) of FIG. 1 connected at upper end (51) and lower end (53) by means of threaded connection surfaces (24) and (26) to extend longitudinally along a pipe string (P) having a central fluid bore. For operation of apparatus (10) when connected to the pipe string P, fluid (F) introduced into the central bore of the pipe string (P) circulates through apparatus (10) through the longitudinal fluid bore (28) of housing (12) and into bore (34) of rotor (48). The majority of the fluid (F) introduced into the bore (34) of the rotor (48) then travels outward through port(s) (30), down flutes (45), back to central bore (34) through ports (32) where it then exits apparatus (10) through bore (46) of bottom sub (22). Bottom sub (22) remains stationary with respect to the rotor (48) during operation. A small portion of the fluid (F) in the fluid bore (34) of the rotor (48) is permitted to travel through the fluid bore orifice (50) where it will then exit apparatus (10) through bore (46) of bottom sub (22). As fluid exits port(s) (30) and is impinge on the interior surface (20) of housing (12), reaction forces cause the rotor (48) to rotate.

The size of orifice (50) and the size, shape, and number of fluid exit port(s) (30) are determined based on the desired torque output and rotational speed of the rotor as well as backpressure created. The size of orifice (50) may also be based on the size of a ball or a wireline toolstring that must be allowed to pass through apparatus (10).

Figure 11:
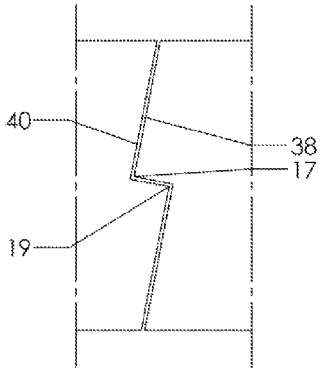
FIG. 11 is a close up view of the saw-tooth profile of the rotor surface and the saw-tooth profile of the bottom sub of the hydraulic percussion apparatus of FIGS. 1 and 6 shown in the nearly closed or impact position.
Figure 12:
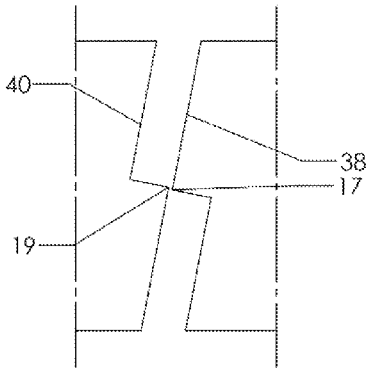
FIG. 12 is a close up view of the saw-tooth profile of the rotor surface and the saw-tooth profile of the bottom sub of the hydraulic percussion apparatus of FIGS. 1 and 6 shown in the nearly fully open or separated position.

The rotation of rotor (48) causes the profiled surfaces (38) and (40), such as the saw-tooth profiled features shown in FIGS. 11 and 12, to intermittently ride and climb along one another, forcing the rotor (48) toward the upper end (51) of apparatus (10) to create a gap between surfaces (38) and (40). As rotation continues, the features of the surfaces (38) and (40) cause the gap between surfaces (38) and (40) to abruptly close to cause profiled hammer surface (38) to fall and collide with profiled anvil surface (40) creating an impact force. This "climbing" and "falling", is shown in FIG. 11 and FIG. 12. The magnitude and frequency of these impact forces can be varied by changes in the rate of rotation and the features of the profiled surfaces for differing applications.

The direction of rotation of the rotor (48) and the direction of the saw-tooth profiles (38) and (40) are designed so that frictional forces generated at the profiled surfaces (38) and (40 aid in maintaining the torque applied at threaded connection surface (42) between the tubular housing (12) and the bottom sub (22). The frictional forces help keep the connection between the tubular housing (12) and the bottom sub (22) at threaded connection surface (42) from "backing off" or becoming loose. This is a key feature of this invention as it is critical the threaded connections do not become loose while the apparatus (10) is in service. A loose connection at threaded connection surface (42) could possibly cause the tubular housing (12) and the bottom sub (22) separate causing apparatus (10) to come apart, requiring a costly and time consuming fishing procedure to retrieve the separated component.

Figure 6:
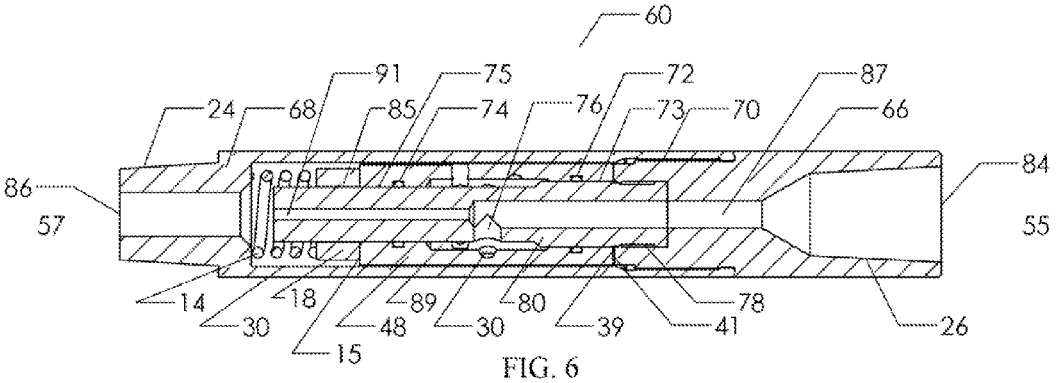
FIG. 6 is a longitudinal cross-section view of an alternate embodiment of the hydraulic percussion apparatus of Applicant's invention.

FIG. 6 shows a second embodiment of the hydraulic percussive apparatus (60) of the present invention utilized to provide upward percussive or hammering forces to a pipe string having a central bore through which fluid may be introduced. The apparatus (60) has an upper end (55) and a lower end (57) and is configured for threadable attachment to the pipe string when deployed in a wellbore.

Apparatus (60) is comprised of a top sub (66) and a tubular housing (68) that is threaded on its radial surfaces where it may be threadedly attached to a tubular housing (68) by means of threaded connection (70). Positioned within the housing (68) is a rotatably mounted longitudinally extending rotor (48), a thrust bearing (18), a mandrel (80), and a spring (14). Housing (68) and rotor (48) are illustrated as a single components but may consist of a multitude of individual parts connected together possibly by one or more of several means such as threaded connections, splines, keyways, welding, brazing, press or shrink fittings, or the like.

The top sub (66) has a central bore (87), a lower end provided with a profiled anvil surface (41), and an upper threaded connection surface (26), shown on box connection (84), configured for threadable attachment of the upper end (55) of the apparatus (60) to the pipe string. The tubular housing (68) has a central bore (86) and a lower threaded connection surface (24), shown as pin connection (85), configured for threadable attachment of the lower end (55) of the apparatus (60) to the pipe string. The central bore (87) of the top sub (66) and the central bore (86) of the tubular housing (68) are in communication with the central bore of the pipe string through which fluid may be introduce to the apparatus (60).

Figure 7:
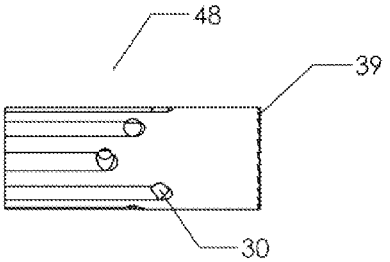
FIG. 7 is a side view of the rotor member of the hydraulic percussion apparatus shown in FIG. 6.
Figure 8:
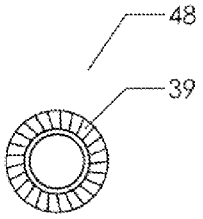
FIG. 8 is an end view of the rotor member of the hydraulic percussion apparatus shown in FIG. 6.

Rotor (48) is comprised of a cylindrical section having a longitudinal fluid bore (89), a tangentially positioned fluid port (30), or plurality of ports (30), and internal radial bearings (73) and (75). The rotor (48) is positioned within the housing (68) to extend axially between the profiled anvil surface (41) of top sub (66) and a thrust bearing (18). The upper face of the rotor (48) has a saw-tooth type profiled hammer surface (39), as shown in FIG. 7 and FIG. 8. This profile feature (39) is constructed to mate and engage with the profiled anvil surface (41) at the lower end of the top sub (66). Profiled surface (39) is shown for simplicity as an integral feature of the rotor (48) but may actually constitute a separate component which is affixed to the rotor (48) by some means such as threads, splines, welding, brazing, keyways, press or shrink fitting, or other connection means commonly known.

Seals (72) and (74) may be mounted on the interior surface of rotor (48) between the rotor (48) and the mandrel (80). These seals may also be mounted on the external surface of mandrel (80). When seals (72) and (74) are provided, it is thought that the seal area provided at seal (72) will be larger than the seal area provided by seal (74).

Profiled surfaces (39) and (41) may have the same configuration as profiled surfaces (38) and (39) of the first embodiment. The features of profiled surfaces (38), (39), (40), and (41) are shown as having saw-tooth profiles but these profiled surface features may be of any suitable form such as waveform, sinusoidal, or other irregular profiled surface. The features of profiled surfaces (38), (39), (40), and (41) are also shown to be of the same size and shape, and are uniform around the entire area circumference of the interfacing profiled surfaces but the features of the profiled surfaces (38), (39), (40), and (41) may be non-uniform and of differing size and shape.

The thrust bearing (18) is positioned within the housing (68) between spring (14) and the rotor (48) and is shown as a thrust sleeve for simplicity and clarity of illustration but the thrust bearing (18) can be of many forms such as those mentioned when discussing the thrust bearing of the embodiment shown in FIG. 1. Thrust bearing surface (15) of thrust bearing (18) is positioned on the lower face of rotor (48). Thrust bearing surface (15) may be simply a polished metal face, hardened and ground, a curved face to receive ball bearings, a flat or tapered face to receive roller bearings. Thrust bearing surface (15) may have or contain hard materials such as carbide or PDC (polycrystalline diamond compact) or be any one of a variety of other types of thrust bearings commonly known in the art. Thrust bearing surface (15) may also be adapted to receive a separate component (not shown) which comprises the aforementioned features to constitute a portion of the thrust bearing (18) or the entirety of the thrust bearing (18).

Spring (14) operates as described above to provide a means for applying a predetermined axial force onto the rotor (48) against the thrust bearing (18) thereby placing rotor profile (39) into contact with profiled surface (41) on the threaded connection (24) at the lower end of the top sub (66). Spring (14) may be any suitable means for producing a biasing force such as coiled compression spring, disc spring, die spring, urethane spring, wave spring, wire spring, tapered spring, or the like. Spring (14) may also consist of more than one spring or type of spring.

Figure 9:
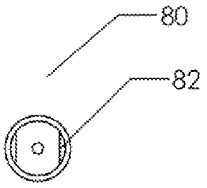
FIG. 9 is an end view of the mandrel of the hydraulic percussion apparatus shown in FIG. 6.
Figure 10:
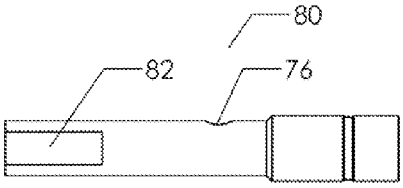
FIG. 10 is a side view of the mandrel of the hydraulic percussion apparatus shown in FIG. 6.

As shown in FIG. 9 and FIG. 10, the mandrel (80) has at least one radial flow port (76), a central fluid entry bore (81) in communication with a central fluid exit bore or orifice (91), and is provided with flats (82) engage with the thrust bearing (18) so as to allow axial motion between mandrel (80) and thrust bearing (18) but disallow relative rotation between mandrel (80) and thrust bearing (18). Splines, keyways, or the like could be utilized as an alternative to the flats (82).

For operation, the hydraulic percussive apparatus (60) is connected to extend longitudinally along a pipe string (P) having a central fluid bore by means of threaded connection surfaces (24) and (26) in a manner similar to that shown in FIG. 13. Fluid introduced into the central fluid bore of the pipe string (P) circulates through the apparatus (60) through the longitudinal fluid bore (87) of top sub (66) and into fluid entry bore (81) of mandrel (80). A small portion of the fluid introduced into the fluid entry bore (81) is permitted to travel through the mandrel (80) into a bore or orifice (91) where it will then exit apparatus (60) through bore (86) of housing (68). The majority of the fluid introduced into the fluid entry bore (81) and then travels through radial flow port(s) (76) into central bore (89) of rotor (48) where the fluid then exits through tangential port(s) (30). The fluid then travels down flutes (93), around outside diameter of thrust bearing (18), across spring (14) and finally into bore (86) of housing (68) where it exits apparatus (60).

As fluid exits port(s) (30) and impinge on the interior surface (30) of housing (68), reaction forces cause the rotor (48) to rotate. Because spring (14) is urging the profiled hammer surface (39) on the rotor (48) against the profiled anvil surface (41) on the lower end of top sub (66), the rotation of the rotor (48) causes profiled surfaces (39) and (41) to ride or climb along one another in a manner similar to that shown in FIG. 11 and FIG. 12. The "climbing" creates an intermittent gap between profiled surfaces (39) and (41) that abruptly closes causing profiled hammer surface (39) to collide against profiled anvil surface (41) creating intermittent impact forces. The magnitude and frequency of these impact forces can be varied for differing applications by changing the profiled surfaces (39) and (41).

The differential seal area provided at seals (72) and (74) causes a differential pressure that urges the rotor (48) upward towards the top sub (66) which aids the spring (14) in placing a compressive force between profiled surface (41) on the rotor (48) and profiled surface (39) on top sub (66). This differential seal area can be predetermined to provide the desired amount of compressive force. This differential seal area may also be predetermined to provide a sufficient compressive force that is adequate such that spring (14) is made unnecessary. If desired, seal areas at (72) and (74) can be configured so that no differential area is created by the seals (72) and (74). In such a case, the compressive force generated between profiles (39) and (41) would strictly be provided by spring (14).

The size of the bore or orifice (91) in the mandrel (80), and the size, shape, and number of fluid ports (30) in the rotor (48), may be determined based on the desired torque output and the desired rotational speed of the rotor as well as the backpressure created by the apparatus (10). The size of orifice (91) may also be based on the size of a ball or wireline toolstring that must be allowed to pass through apparatus (60).

The direction of rotation of the rotor (48) and the direction of the saw-tooth profiles (39) and (41) are designed such that frictional forces aid in maintaining the torque applied to threaded connections (70) and (78). These frictional forces help keep threaded connections (70) and (78) from "backing off" or becoming loose. The percussive or hammering mechanism of apparatus (60), the second embodiment of the invention, is the same as that in apparatus (10), the first embodiment.

FIG. 11 is a close up view of an embodiment of the profiled hammer surface (38) in close proximity to the corresponding profiled anvil surface (40) just prior to their impact. In this embodiment the profiled surfaces (38) and (40) are shown as having saw-tooth profiles having corresponding saw-tooth peak points (17) and (19), respectively. Profiled surfaces (39) and (41) may have the same or similar saw-tooth configuration.

FIG. 12 is a close up view of profiled surfaces (38) and (40) of FIG. 11, illustrating the gap between profiled surfaces (38) and (40) just before peak point (17) of profiled hammer surface (38) is rotated past peak point (19) of the profiled anvil surface (40). It must be noted that profiled surfaces (38) and (40) are illustrated as having sharp corners and peaks for clarity but the profiled surfaces may contain radii, flats, or other features that aid in providing the desired percussive effect.

It is thought that the hydraulic percussion apparatus and method of use of the present invention and many of its attendant advantages will be understood from the foregoing description. It will also be apparent that various changes may be make in the form, construction and arrangement of the parts of the invention and the method steps without departing from the spirit and scope of the invention or sacrificing all of its material advantages, the form described herein being merely a preferred or exemplary embodiment of the invention.

I claim:

1. An apparatus for imparting repeated percussions or impacts to a wellbore pipe string comprising:

(a) a tubular housing having a longitudinally extending central bore whereby a fluid is introduced when connected to the pipe string;

(b) a tubular compression sleeve positioned in said tubular housing in a manner allowing relative axial movement of said compression sleeve while disallowing relative rotational movement;

(c) a tubular rotor positioned within said tubular housing, said rotor having an upper end, a lower end having a hammer surface, a longitudinally extending fluid bore in communication with said central bore of said housing, said fluid bore having a flow restriction orifice at a lower end of the fluid bore, a tangentially positioned fluid port in communication with said longitudinal fluid bore of said rotor in fluid communication with the annulus between said housing and said rotor, said fluid port having an axis that extends transverse to but does not intersect the longitudinal axis of said tubular rotor, and whereby said introduced fluid from said housing entering said longitudinally extending fluid bore of said rotor and exiting said tangentially oriented fluid port of said rotor and reentering said housing causes rotation of said rotor;

(d) a means for producing a biasing force to urge said compression sleeve against said rotor;

(e) an irregular surface profile on said lower hammer surface of said rotor;

(f) a bottom sub having a longitudinally extending central bore and an upper anvil surface, said bottom sub positioned on said housing whereby said anvil surface of said bottom sub interfaces with said lower hammer surface of said rotor; and (g) an irregular surface profile on said anvil surface of said bottom sub whereby said rotation of said rotor relative to said bottom sub on said irregular surface profiles of said lower hammer surface of said rotor and said anvil surface of said bottom causes a repeated axial reciprocation of the rotor hammer surface against the bottom sub anvil surface thereby producing repeated impact forces.

2. The apparatus of claim 1 wherein a magnitude of said impact force is varied by changing said irregular surface profile of said rotor and said irregular surface profile of said bottom sub.

3. The apparatus of claim 1 wherein a magnitude of said impact force is varied by changing the mass of said rotor.

4. The apparatus of claim 1 wherein a magnitude of said impact force is varied by changing said biasing force.

5. The apparatus of claim 1 wherein a magnitude of said impact force is varied by changing the diameter of said flow restriction orifice in said longitudinal fluid bore of said rotor.

6. The apparatus of claim 1 further comprising:

(a) a radial fluid port in said rotor into said central bore of said bottom sub; and (b) a flute on the periphery of said rotor extending between said radial fluid port in said rotor and said tangentially positioned fluid port in communication with said longitudinal fluid bore of said rotor.

7. The apparatus of claim 6 further comprising a thrust bearing positioned between said upper surface of said rotor and said compression sleeve.

8. The apparatus of claim 7 wherein said means for producing a biasing force to urge said compression sleeve toward said upper surface of said rotor is selected from the group consisting of coiled springs, die springs, urethane springs, and disc springs.

9. The apparatus of claim 8 wherein said irregular surface profiles of said lower hammer surface of said rotor and said anvil surface of said bottom are saw-tooth surface profiles.

10. An apparatus for imparting repeated percussions or impacts to a wellbore pipe string comprising:

(a) a top sub having upper and lower ends, said top sub upper end configured for threadable attachment to a pipe string having a central fluid bore via an upper threaded connection, said lower end of said top sub having a saw-toothed anvil surface and a lower threaded connection, said top sub being in communication with said central bore of said pipe string whereby a fluid is introduced when connected to the pipe string;

(b) a tubular housing having upper and lower end, said upper end of said housing threadedly attached to said lower threaded connection of said top sub, said housing having a central bore in communication with said central bore of said pipe string;

(c) a rotatably mounted rotor having upper and lower ends positioned within said housing, said rotor having a saw-toothed hammer surface at an upper end of the rotor, a longitudinal fluid bore in communication with said central bore of said top sub, and at least one tangentially positioned fluid port in communication said longitudinal fluid bore of said rotor;

(d) a longitudinally extending mandrel configured to receive said rotor, said mandrel mounted in said tubular housing in a manner allowing relative axial movement of said mandrel while disallowing relative rotational movement, said mandrel having a longitudinal fluid bore in communication with said longitudinal fluid bore of said rotor, a central fluid exit orifice in said longitudinal fluid bore of said mandrel, and a radial fluid exit port in communication with said mandrel fluid bore;

(e) a spring positioned in said housing, said spring urging said rotor upwardly to urge profiled hammer surface at said upper end of said rotor against said profiled anvil surface at said lower end of said top sub; and (f) whereby fluid introduced into said mandrel fluid bore from said pipe string through said top sub exits said mandrel fluid bore and enters said longitudinally extending fluid bore of said rotor to exit said tangentially oriented fluid port of rotor to be impinged by said housing thereby causing rotation of said rotor and said saw-toothed hammer surface on said anvil and said saw-toothed anvil surface of said top sub to repeatedly move said rotor hammer surface against said top sub anvil surface producing an impact force.

11. The apparatus of claim 10 further comprising a thrust bearing positioned between said spring and said lower end of rotor.

12. The apparatus of claim 11 wherein said spring is selected from the group consisting of coiled springs, die springs, urethane springs, and disc springs.

13. The apparatus of claim 12 further comprising a means for varying a magnitude of said impact force wherein said means for varying the magnitude of said impact force includes varying the profile of said saw-toothed hammer surface of said rotor and said anvil surface of said top sub; changing the mass of said rotor; changing said spring; or changing the diameter of said central fluid exit orifice in said mandrel.

14. An apparatus for imparting repeated percussions or impacts to a wellbore pipe string comprising:

(a) a tubular housing attached to a pipe string in a wellbore;

(b) a tubular rotor positioned within said tubular housing, said rotor having a longitudinally extending axis, a hammer surface with an irregular surface profile, a longitudinally extending fluid bore, and at least one tangentially oriented fluid port extending transverse to but not intersecting said longitudinal axis of said tubular rotor in communication with said longitudinal fluid bore of said rotor in fluid communication with an annulus between said housing and said rotor;

(c) an anvil with an irregular surface profile positioned in said housing adjacent said rotor whereby said anvil interfaces with said hammer surface of said rotor;

(d) a tubular compression sleeve positioned in said tubular housing urged to move said hammer surface of said rotor axially toward said anvil; and (e) fluid entering said longitudinally extending fluid bore of said rotor and exiting said tangentially oriented fluid port of said rotor into said annulus between said housing and said rotor, said fluid thereby rotating said irregular surface profiles of said hammer surface of said rotor on said irregular surface of said anvil whereby said hammer surface is moved to repeatedly collide with said anvil surface producing a repeated impact force.

15. The apparatus of claim 14 wherein said tubular compression sleeve is urged to move without relative rotational movement of said compression sleeve within said housing.

16. The apparatus of claim 15 wherein said tubular compression sleeve is urged to move said hammer surface of said rotor axially toward said anvil by a spring.

17. The apparatus of claim 16 further comprising:

(a) a radial fluid exit port in said rotor; and (b) a flute on the periphery of said rotor extending between said radial fluid port in said rotor and said tangentially positioned fluid port in communication with said longitudinal fluid bore of said rotor.

18. The apparatus of claim 17 further comprising a thrust bearing positioned between said upper surface of said rotor and said compression sleeve.

19. An apparatus for imparting repeated percussions or impacts to a wellbore pipe string comprising:

(a) a tubular housing attached to a pipe string in a wellbore;

(b) a fluid rotatable tubular rotor positioned within said tubular housing, said rotor having a longitudinally extending axis, a central fluid bore along said longitudinally extending axis, a hammer surface with a regular surface profile;

(c) an anvil with an irregular surface profile positioned in said housing adjacent said rotor whereby said anvil interfaces with said hammer surface of said rotor;

(d) an axially movable tubular compression sleeve positioned in said tubular housing, said compression sleeve urged against said rotor to allow said hammer surface of said rotor to move axially toward and away from said anvil; and (e) fluid rotating said rotor and thereby rotating said irregular surface profiles of said hammer surface of said rotor on said irregular surface of said anvil whereby said hammer surface is moved toward and away from said anvil producing an impact force on said pipe string.

20. In a wellbore pipe string having a central bore for containing a fluid column, a method for vibrating said pipe string in said wellbore comprising the steps of:

(a) providing a percussion apparatus comprised of:

(i) a tubular housing configured for attachment to said pipe string;

(ii) a tubular rotor positioned within said tubular housing, said rotor having a longitudinally extending axis, a hammer surface with an irregular surface profile, a longitudinally extending fluid bore configured for communication with said central bore of said pipe string, and at least one tangentially oriented fluid port extending transverse to but not intersecting said longitudinal axis of said tubular rotor in communication with said longitudinal fluid bore of said rotor and an annulus between said housing and said rotor;

(iii) an anvil with an irregular surface profile positioned in said housing adjacent said rotor whereby said anvil interfaces with said hammer surface of said motor;

(iv) a tubular compression sleeve positioned in said tubular housing urged to move said hammer surface of said rotor axially toward and away from said anvil;

(b) attaching said percussion apparatus to said pipe string;

(c) introducing fluid into said pipe string;

(d) entering said fluid from said pipe string into said longitudinally extending fluid bore of said rotor;

(e) exiting said fluid from said longitudinally extending fluid bore of said rotor through said tangentially oriented fluid port of said rotor into said annulus between said housing and said rotor and thereby rotating said rotor and irregular surface profiles of said hammer surface of said rotor on said irregular surface of said anvil whereby said hammer surface is moved against and away from said anvil producing a repeated impact force and vibrating said pipe string.

21. The method of claim 20 wherein said tubular compression sleeve is urged to move without relative rotational movement of said compression sleeve within said housing.

22. The method of claim 21 comprising the step of urging said tubular compression sleeve to move said hammer surface of said rotor axially toward said anvil by a compression spring.

23. The method of claim 22 further comprising the step of providing a means for varying a magnitude of said impact force wherein said means for varying the magnitude of said impact force includes varying said irregular surface profile of said hammer surface of said rotor; varying said irregular surface profile of said anvil; changing the mass of said rotor; changing the urging force on said compression sleeve; or changing the diameter of said tangentially oriented fluid port of said rotor.

24. The apparatus of claim 16 further comprising a means for varying a magnitude of said impact force wherein said means for varying the magnitude of said impact force includes varying said irregular surface profile of said hammer surface of said rotor; varying said irregular surface profile of said anvil; changing the mass of said rotor; changing the urging force on said compression sleeve; or changing the diameter of said tangentially oriented fluid port of said rotor.

25. An apparatus for imparting repeated percussions or impacts to a wellbore pipe string comprising:

(a) a top sub having an upper end configured for threadable attachment to a pipe string having a central fluid bore via an upper threaded connection and a lower end having profiled anvil surface and a lower threaded connection, said top sub in communication with said central fluid bore of said pipe string;

(b) a tubular housing having a central bore in communication with said central bore of said pipe string and an upper end threadedly attached to said lower threaded connection of said top sub;

(c) a rotatably mounted rotor positioned within said housing, said rotor having an upper end with a profiled hammer surface urged against said profiled anvil surface of said top sub, a longitudinal fluid bore in communication with said central bore of said top sub, and at least one tangentially positioned fluid port in communication said longitudinal fluid bore of said rotor;

(d) a longitudinally extending mandrel configured to receive said rotor, said mandrel mounted in said tubular housing in a manner allowing relative axial movement of said mandrel while disallowing relative rotational movement, said mandrel having a longitudinal fluid bore in communication with said longitudinal fluid bore of said rotor, a radial fluid port in communication with said mandrel longitudinal fluid bore, and a central fluid exit orifice in said longitudinal fluid bore of said mandrel; and (e) fluid introduced from said top sub from said central bore of said pipe string to said mandrel, said fluid exiting said mandrel through said mandrel radial fluid port, entering said longitudinally extending fluid bore of said rotor, exiting said tangentially oriented fluid port of said rotor to be impinged by said housing, said exiting fluid thereby causing rotation of said rotor to rotate said irregular surface profiles of said rotor hammer surface on said irregular surface profiles of said anvil surface of said top sub producing a repeated impact force on said pipe string.

26. The apparatus of claim 25 further comprising a spring positioned in said housing, said spring urging said profiled hammer surface of said rotor against said profiled anvil surface of said top sub.

27. The apparatus of claim 26 further comprising a thrust bearing positioned between said spring and said lower end of rotor.

28. The apparatus of claim 27 further comprising a means for varying a magnitude of said impact force wherein said means for varying the magnitude of said impact force includes varying said profiled hammer surface of said rotor and said anvil surface of said top sub; changing the mass of said rotor; changing said spring; or changing the diameter of said central fluid exit orifice in said mandrel.

29. The apparatus of claim 25 wherein said profiled hammer surface of said rotor is against said profiled anvil surface of said top sub by a means of differential pressures within said housing.

30. In a wellbore pipe string having a central bore for containing a fluid column, a method for vibrating said pipe string in said wellbore comprising the steps of:

(a) providing a percussion apparatus comprised of:

(i) a top sub having an upper end configured for threadable attachment to a pipe string having a central fluid bore via an upper threaded connection, a lower end ridged anvil surface, and a lower threaded connection, said top sub in communication with said central fluid bore of said pipe string;

(ii) a tubular housing having a central bore in communication with said central bore of said pipe string and an upper end threadedly attached to said lower threaded connection of said top sub;

(iii) a rotatably mounted rotor positioned within said housing, said rotor having an upper end with a ridged surface hammer surface, a longitudinal fluid bore in communication with said central bore of said top sub, and at least one tangentially positioned fluid port in communication said longitudinal fluid bore of said rotor in communication with an annulus between said housing and said rotor, said profiled hammer surface of said rotor urged against said profiled anvil surface of said top sub;

(iv) a longitudinally extending mandrel configured to receive said rotor, said mandrel mounted in said tubular housing in a manner allowing relative axial movement of said mandrel while disallowing relative rotational movement, said mandrel having a longitudinal fluid bore in communication with said longitudinal fluid bore of said rotor, a radial fluid port in communication with said mandrel longitudinal fluid bore, and a central fluid exit orifice in said longitudinal fluid bore of said mandrel; and (b) attaching said percussion apparatus to said pipe string;

(c) introducing fluid into said pipe string;

(d) entering said fluid from said pipe string into said top sub and into said longitudinal fluid of said mandrel;

(e) exiting said fluid from said mandrel through said mandrel radial fluid port;

(f) entering said fluid into said longitudinally extending fluid bore of said rotor;

(g) exiting said fluid from said longitudinally extending fluid bore of said rotor through said tangentially oriented fluid port of said rotor into said annulus between said housing and said rotor and impinging said fluid by said housing; and (h) rotating said rotor to rotate said ridged hammer surface of said rotor on said ridged anvil surface of said top sub thereby moving said rotor hammer surface away from and against said anvil surface producing repeated impact forces on said pipe string.

* * * * *